US011752508B2

(12) United States Patent
Liu et al.

(10) Patent No.: US 11,752,508 B2
(45) Date of Patent: Sep. 12, 2023

(54) WATER-FERTILIZER-PESTICIDE INTEGRATED MULTIFUNCTIONAL IRRIGATION SPRAY HEAD

(71) Applicant: JIANGSU UNIVERSITY, Zhenjiang (CN)

(72) Inventors: Junping Liu, Zhenjiang (CN); Hong Li, Zhenjiang (CN); Shouqi Yuan, Zhenjiang (CN); Xingye Zhu, Zhenjiang (CN); Yangfan Li, Zhenjiang (CN)

(73) Assignee: JIANGSU UNIVERSITY, Zhenjiang (CN)

( * ) Notice: Subject to any disclaimer, the term of this patent is extended or adjusted under 35 U.S.C. 154(b) by 610 days.

(21) Appl. No.: 17/253,142

(22) PCT Filed: Jun. 13, 2018

(86) PCT No.: PCT/CN2018/091050

§ 371 (c)(1),
(2) Date: Dec. 17, 2020

(87) PCT Pub. No.: WO2019/148736

PCT Pub. Date: Aug. 8, 2019

(65) Prior Publication Data

US 2021/0245179 A1 Aug. 12, 2021

(30) Foreign Application Priority Data

Jan. 31, 2018 (CN) ..... 201810098168.9

(51) Int. Cl.
*B05B 1/34* (2006.01)
*B05B 1/30* (2006.01)

(52) U.S. Cl.
CPC ..... *B05B 1/3478* (2013.01); *B05B 1/3006* (2013.01)

(58) Field of Classification Search
CPC ..... B05B 1/12; B05B 1/3006; B05B 1/341; B05B 1/3415; B05B 1/3431;
(Continued)

(56) References Cited

U.S. PATENT DOCUMENTS 2,608,442 A * 8/1952 Marshall ..... B05B 1/12 239/481
4,886,213 A * 12/1989 Kristensen ..... B05B 9/00 239/581.2

(Continued)

FOREIGN PATENT DOCUMENTS

CN 203253563 U 10/2013
CN 203803675 U 9/2014

(Continued)

*Primary Examiner* — Darren W Gorman
(74) *Attorney, Agent, or Firm* — Bayramoglu Law Offices LLC

(57) ABSTRACT

A water-fertilizer-pesticide integrated multifunctional irrigation spray head, mainly including a first spray hole, a second spray hole, a spray head cap, a spray head body, an atomization core, water passing holes, springs, cover sheets, a pipe connector, water outlet holes, a throat cavity, a chamfered groove, and a helical groove. The spray head is configured as a double-flow channel structure. The spray head body and the atomization core are provided in the spray head cap. The atomization core is provided in an inner cavity of the spray head body and is threadedly connected. The bottom of the spray head body is provided with cover sheets, each of the cover sheets is connected by a respective one of the springs. When the working pressure is a low pressure, the cover sheets are in an open state, and the liquid is sprayed by means of two flow channels.

18 Claims, 9 Drawing Sheets

(58) Field of Classification Search
CPC ... B05B 1/3442; B05B 1/3447; B05B 1/3478; B05B 1/3489
See application file for complete search history.

(56) References Cited

U.S. PATENT DOCUMENTS

| | | | | | |
|---|---|---|---|---|---|
| 4,899,937 | A * | 2/1990 | Haruch | ..... | B05B 12/088 239/289 |
| 2018/0058684 | A1 * | 3/2018 | Qiu | ..... | B05B 1/14 |

FOREIGN PATENT DOCUMENTS

| | | | | | |
|---|---|---|---|---|---|
| CN | 104984841 | A | 10/2015 | | |
| CN | 105080743 | A | 11/2015 | | |
| DE | 19645004 | A1 | 5/1998 | | |
| DE | 10000820 | A1 * | 7/2001 | ..... | B05B 1/3006 |
| DE | 10222650 | A1 * | 12/2003 | ..... | B05B 1/12 |

* cited by examiner

WATER-FERTILIZER-PESTICIDE INTEGRATED MULTIFUNCTIONAL IRRIGATION SPRAY HEAD

CROSS REFERENCE TO THE RELATED APPLICATIONS

This application is the national stage entry of International Application No. PCT/CN2018/091050, filed on Jun. 13, 2018, which is based upon and claims priority to Chinese Patent Application No. 201810098168.9, filed on Jan. 31, 2018, the entire contents of which are incorporated herein by reference.

TECHNICAL FIELD

The present invention pertains to the technical field of agricultural sprinkler irrigation, and relates to a spraying apparatus, and more particularly, to a water-fertilizer-pesticide integrated multifunctional irrigation spray head.

BACKGROUND

At present, China regards water-saving irrigation as a major strategic task for sustainable economic and social development. The vigorous promotion of the integration of water, fertilizer and pesticide plays a key role in the stable increase of agricultural output. In the planting of fruit trees in hilly areas in China, the system of quantitative irrigation and fertilizer/pesticide application for grape crops is not perfect. Especially in the process of irrigation and fertilizer/pesticide application, micro-spray heads are needed for irrigation and atomization spray heads are needed to apply fertilizer and spray pesticide to leaves. Most of the fertilizer/pesticide applications require manual spraying. Even if a pipeline system is adopted, a set of micro-sprinkler irrigation system different from irrigation is required, which increases the complexity of the system. Therefore, it is of great significance in practice to realize both the irrigation function and the fertilizer/pesticide application function in the same sprinkler irrigation system. This requires the spray head in the system to not only meet the requirements on irrigation indicators, but also meet the requirements on fertilizer/pesticide application indicators. The spray head is a key constituent of a water-fertilizer-pesticide integrated system, and directly affects the effect of irrigation and fertilizer/pesticide application of the system. Spray head products at home and abroad only have a single function, i.e., the micro-spray head can only meet the irrigation performance, and the atomization spray head can only meet the fertilizer/pesticide application performance.

In view of the above problems, a water-fertilizer-pesticide integrated multifunctional spray head with a simple structure needs to be developed. The spray head can be used for micro-irrigation of roots of grape crops under a low pressure (greater than 100 kPa and less than or equal to 200 kPa), and used for atomizing and spraying the pesticide and fertilizer to the back of the leaves of the grape crops under a medium to high pressure (greater than 200 kPa and less than 500 kPa). As one single spray head can provide multiple functions, the complexity of the pipeline of the water-fertilizer-pesticide integrated system is reduced, which meets the requirements of modern agriculture for water and energy conservation and promotes the modernization of agriculture.

SUMMARY

An objective of the present invention is to provide a water-fertilizer-pesticide integrated multifunctional irrigation spray head, to reduce the complexity of the water-fertilizer-pesticide integrated system and realize both an irrigation function and a fertilizer/pesticide application function in the same sprinkler irrigation system, thereby achieving a spray head with diversified functions.

To achieve the above objective, the present invention adopts the following technical solution: A water-fertilizer-pesticide integrated multifunctional irrigation spray head, including a pipe connector and a spray head cap, the spray head cap being mounted on the pipe connector, wherein the spray head cap is provided with a first spray hole, a spray head body is nested inside the spray head cap, the spray head body is provided with a second spray hole at a position corresponding to the first spray hole, and a diameter of the second spray hole is less than a diameter of the first spray hole; one end of the spray head body located at the pipe connector is provided with a plurality of water passing holes, a spring is mounted at each of the water passing holes, a cover sheet is fixed at an inlet of each of the water passing holes by means of the spring, and the first spray hole is in communication with the water passing holes through a cavity defined by an outer surface of the spray head body and an inner surface of the spray head cap; and an atomization core is nested inside the spray head body, the atomization core is provided with an atomization core inlet at the pipe connector, and the second spray hole is in communication with the atomization core inlet through a cavity defined by an outer surface of the atomization core and an inner surface of the spray head body.

In the above solution, the spray head cap includes an upper cap and a lower cap, the spray head body includes a first connection body, a second connection body and a first truncated cone body, the water passing holes are provided on the first connection body, the second spray hole is provided on the first truncated cone body, an outer wall of the first connection body conforms and is fixed to an inner wall of the lower cap, an outer wall of the second connection body conforms and is fixed to an inner wall of the upper cap, the first connection body and the second connection body are connected by a third connection body, the second connection body is provided with a chamfered groove, the chamfered groove communicates a cavity defined by an outer wall of the first truncated cone body and the inner wall of the upper cap with a cavity defined by an outer wall of the third connection body and the inner wall of the upper cap, and the water passing holes are in communication with the cavity defined by the outer wall of the third connection body and the inner wall of the upper cap.

In the above solution, a cross-section of the first spray hole is a truncated cone-shaped cross-section, and a cross-section of the second spray hole is a cylindrical cross-section.

In the above solution, the outer wall of the first connection body is threadedly connected to the inner wall of the lower cap, and the outer wall of the second connection body is threadedly connected to the inner wall of the upper cap.

In the above solution, an angle $\alpha$ between the chamfered groove and a horizontal plane is in a range of $28° \leq \alpha \leq 32°$.

In the above solution, the atomization core includes a first core body, a second core body and a second truncated cone body, the atomization core inlet is provided on the first core body, the second core body is located inside the first truncated cone body, an outer wall of the first core body conforms and is fixed to inner walls of the first connection body and the third connection body, an outer wall of the second truncated cone body conforms and is fixed to an inner wall of the first truncated cone body, the second truncated cone body is provided with a helical groove, the second core body is provided with a plurality of circular water outlet holes, and the circular water outlet holes are in communication with the atomization core inlet.

In the above solution, the outer wall of the first core body is threadedly connected to the inner walls of the first connection body and the third connection body, and the outer wall of the second truncated cone body is threadedly connected to the inner wall of the first truncated cone body.

In the above solution, an angle β between the helical groove and a horizontal plane is in a range of $40° \leq \beta \leq 50°$.

In the above solution, the pipe connector is threadedly connected to the spray head cap.

In the above solution, a pressure regulating valve is mounted on the pipe connector.

The present invention has the following beneficial effects: The water-fertilizer-pesticide integrated multifunctional irrigation spray head of the present invention has a simple structure, is reliable to operate and convenient to use, and can provide different spraying modes under different pressures to achieve different functions.

Figure 1:
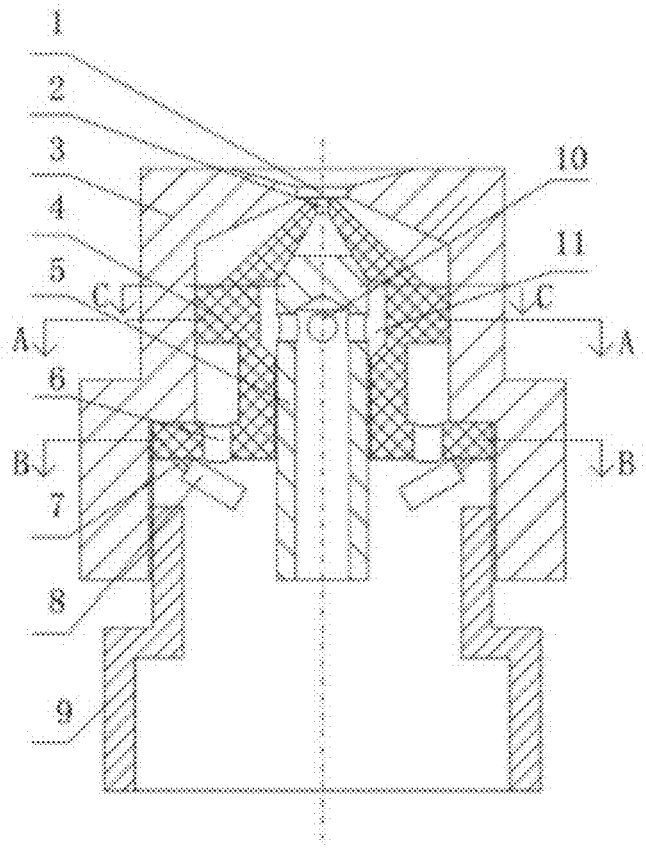
FIG. 1 is a schematic front cross-sectional view of a spray head.

In the drawings: 1. first spray hole; 2. second spray hole; 3. spray head cap; 3-1. upper cap; 3-2. lower cap; 4. spray head body; 4-1. first connection body; 4-2. second connection body; 4-3. third connection body; 4-4. first truncated cone body; 5. atomization core; 5-1. first core body; 5-2. second core body; 5-3. second truncated cone body; 6. water passing hole; 7. spring; 8. cover sheet; 9. pipe connector; 10. circular water outlet hole; 11. throat cavity; 12. chamfered groove; 13. helical groove.

DETAILED DESCRIPTION OF THE EMBODIMENTS

The technical solutions of the present invention will be described in further detail below with reference to the accompanying drawings.

Figure 2:
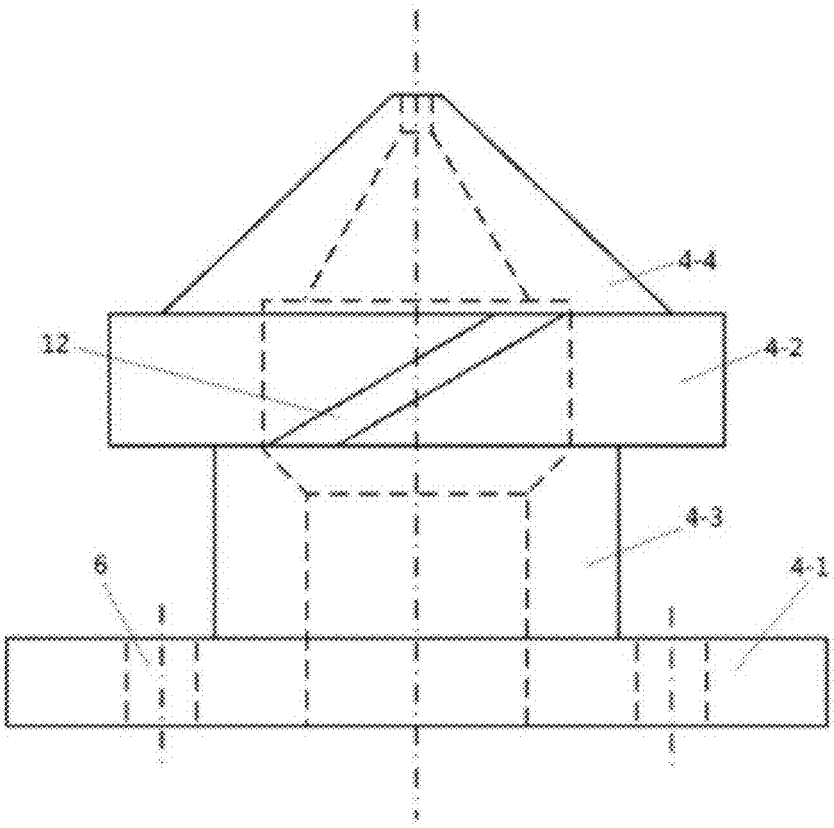
FIG. 2 is a schematic side view of a spray head body.
Figure 3:
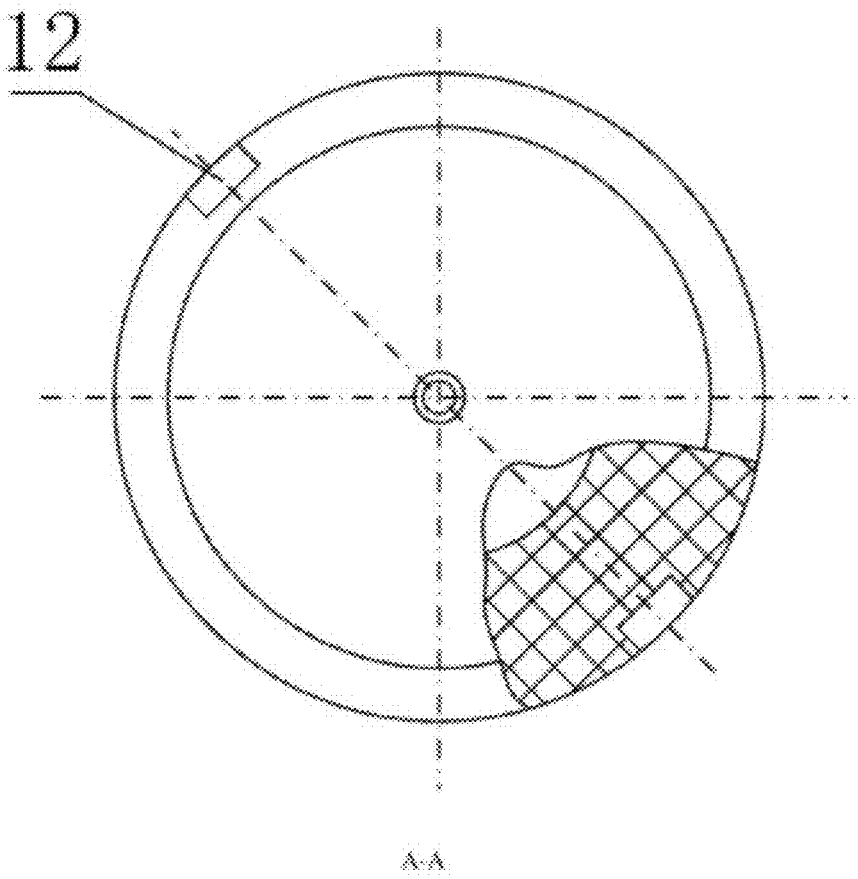
FIG. 3 is a schematic cross-sectional view taken along line A-A.
Figure 4:
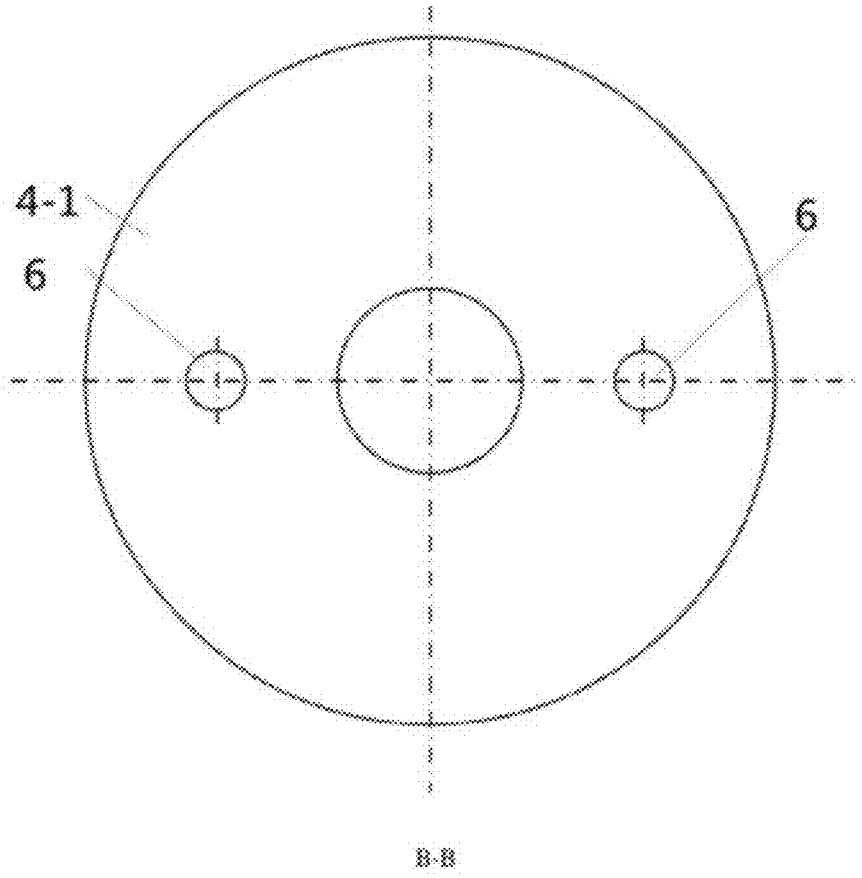
FIG. 4 is a schematic cross-sectional view taken along line B-B.
Figure 5:
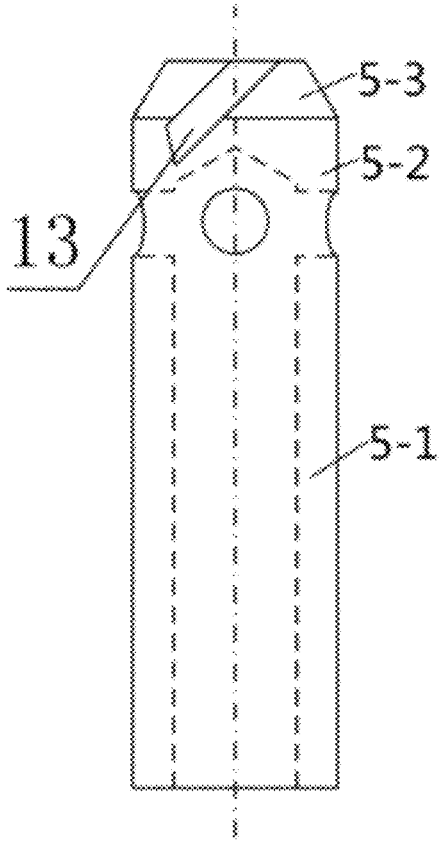
FIG. 5 is a schematic side view of an atomization core.
Figure 6:
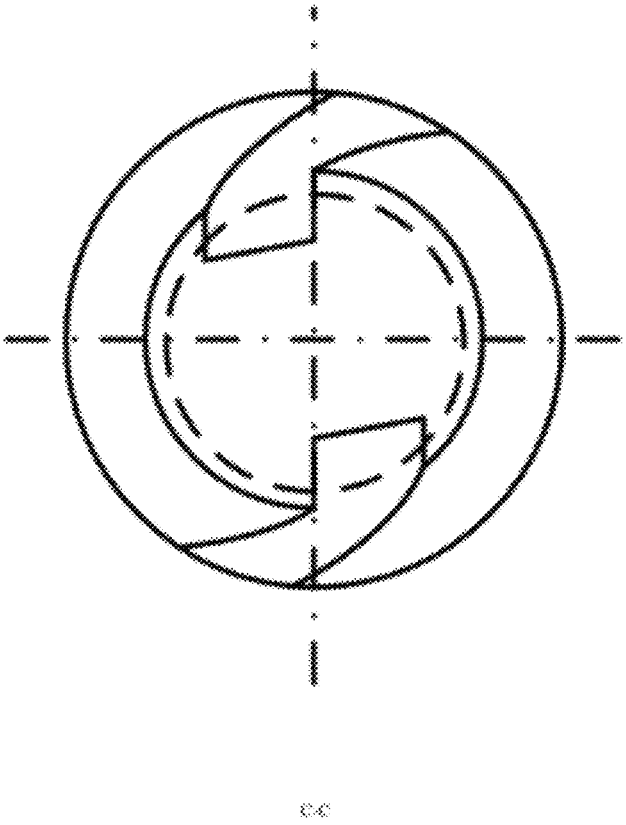
FIG. 6 is a schematic cross-sectional view taken along line C-C.
Figure 7:
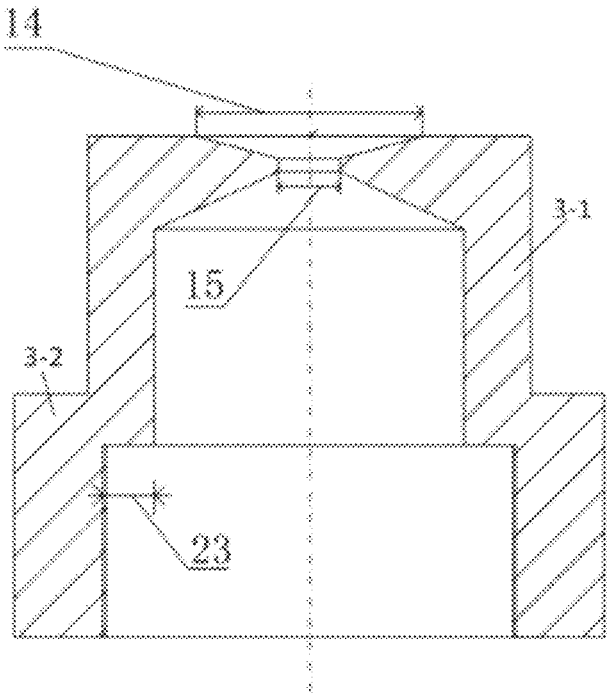
FIG. 7 is a schematic front cross-sectional view of a spray head cap.
Figure 8:
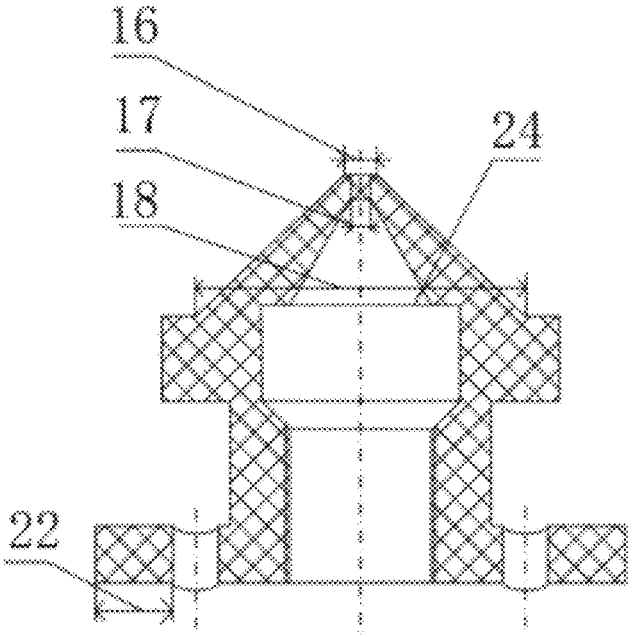
FIG. 8 is a schematic front cross-sectional view of a spray head body.
Figure 9:
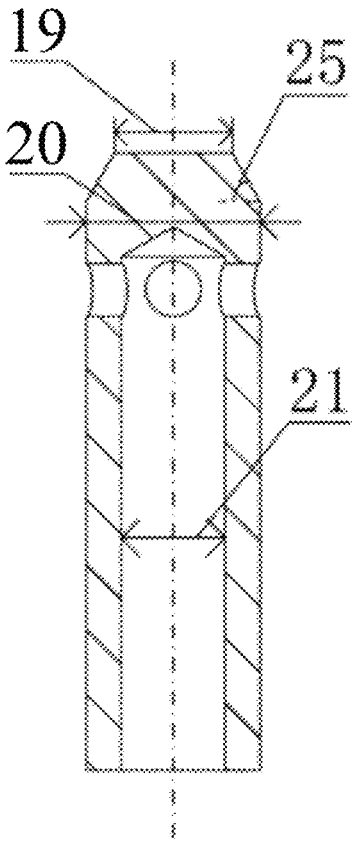
FIG. 9 is a schematic front cross-sectional view of the atomization core.

As shown in FIG. 1, a water-fertilizer-pesticide integrated multifunctional irrigation spray head according to this embodiment includes a pipe connector 9 and a spray head cap 3. The spray head cap 3 is mounted on the pipe connector 9. A pressure regulating valve is mounted on the pipe connector 9. The spray head cap 3 is provided with a first spray hole 1. A spray head body 4 is nested inside the spray head cap 3. An atomization core 5 is nested inside the spray head body 4. The spray head cap 3 includes an upper cap 3-1 and a lower cap 3-2 (as shown in FIG. 7). The spray head body 4 includes a first connection body 4-1, a second connection body 4-2 and a first truncated cone body 4-4. Water passing holes 6 are provided on the first connection body 4-1 (as shown in FIG. 2 and FIG. 4). The second spray hole 2 is provided on the first truncated cone body 4-4. A diameter of the second spray hole 2 is less than a diameter of the first spray hole 1. An outer wall of the first connection body 4-1 conforms and is fixed to an inner wall of the lower cap 3-2. An outer wall of the second connection body 4-2 conforms and is fixed to an inner wall of the upper cap 3-1. The first connection body 4-1 and the second connection body 4-2 are connected by a third connection body 4-3. The second connection body 4-2 is provided with a chamfered groove 12 (as shown in FIG. 3). The chamfered groove 12 communicates a cavity defined by an outer wall of the first truncated cone body 4-4 and the inner wall of the upper cap 3-1 with a cavity defined by an outer wall of the third connection body 4-3 and the inner wall of the upper cap 3-1. The water passing holes 6 are in communication with the cavity defined by the outer wall of the third connection body 4-3 and the inner wall of the upper cap 3-1. A cross-section of the first spray hole 1 is a truncated cone-shaped cross-section, and a cross-section of the second spray hole 2 is a cylindrical cross-section. A spring 7 is mounted at each of the water passing holes 6. A cover sheet 8 is fixed at an inlet of each of the water passing holes 6 by means of the spring 7. The first spray hole 1 is in communication with the water passing holes 6 through a cavity defined by an outer surface of the spray head body 4 and an inner surface of the spray head cap 3. An atomization core 5 is nested inside the spray head body 4. The atomization core 5 is provided with an atomization core inlet at the pipe connector 9. The atomization core 5 includes a first core body 5-1, a second core body 5-2 and a second truncated cone body 5-3 (as shown in FIG. 5 and FIG. 6). The atomization core inlet is provided on the first core body 5-1. The second core body 5-2 is located inside the first truncated cone body 4-4. An outer wall of the first core body 5-1 conforms and is fixed to inner walls of the first connection body 4-1 and the third connection body 4-3. An outer wall of the second truncated cone body 5-3 conforms and is fixed to an inner wall of the first truncated cone body 4-4. The second truncated cone body 5-3 is provided with a helical groove 13. An outer wall of the second core body 5-2 and an inner wall of the second connection body 4-2 form a throat cavity 11. The second core body 5-2 is provided with a plurality of circular water outlet holes 10. The circular water outlet holes 10 are in communication with the atomization core inlet (as shown in FIG. 5), so that the second spray hole 2 is in communication with the atomization core inlet through a cavity defined by an outer surface of the atomization core 5 and the inner surface of the spray head body 4.

Preferably, the outer wall of the first connection body 4-1 is threadedly connected to the inner wall of the lower cap 3-2, and the outer wall of the second connection body 4-2 is threadedly connected to the inner wall of the upper cap 3-1. The outer wall of the first core body 5-1 is threadedly connected to the inner walls of the first connection body 4-1 and the third connection body 4-3, and the outer wall of the second truncated cone body 5-3 is threadedly connected to the inner wall of the first truncated cone body 4-4. The pipe connector 9 is threadedly connected to the spray head cap 3.

Specifically in this embodiment, the first spray hole 1 at a top end of the spray head cap 3 has an outer diameter $D_1$ 14 and an inner diameter $D_2$ 15, where $D_1 > D_2$. An upper end of the spray head body 4 is in the shape of a truncated cone having an upper bottom surface diameter $D_3$ 16 and a lower bottom surface diameter $D_5$ 18, where $D_5 > D_3$. The second spray hole 2 is provided at an inner cavity of an upper end of the first truncated cone body 4-4. The second spray hole has a diameter $D_4$ 17, where $D_5>D_1>D_2>D_3>D_4$. A shortest distance between an inner wall surface of each of the water passing holes 6 and an outer side surface of the first connection body 4-1 is $L_1$ 22, and a shortest distance between an inner wall surface of the upper cap and an inner wall surface of the lower cap of the spray head cap is $L_2$ 23, where $L_1>L_2$. The cover sheet 8 is connected to the spring 7 by welding. The spring 7 is connected to the bottom of the spray head body 4 by welding. The second truncated cone body 5-3 at an upper end of the atomization core has an upper bottom surface diameter $D_6$ 19 and a lower bottom surface diameter $D_7$ 20, where $D_7>D_6$. An angle δ 25 between the side wall surface of the second truncated cone body 5-3 and the horizontal plane is the same as an angle γ 24 between the side wall surface of the first truncated cone body 4-4 at the upper end of the spray head body and the horizontal plane. Two helical grooves 13 having the same width are distributed symmetrically on the second truncated cone body 5-3. Four circular water outlet holes 10 having the same diameter are evenly distributed on the second core body 5-2 of the atomization core 5. The circular water outlet holes 10 are connected to the throat cavity 11. The atomization core inlet has an inner cavity diameter $D_8$ 21, where $D_7>D_6>D_8$. The pipe connector 9 is provided with a liquid inlet. The spray head cap 3 is threadedly connected to the pipe connector 9.

The working process is as follows. Flow state under a low pressure: When the pressure regulating valve on the system pipeline adjusts the pressure to a low value, i.e., a low inlet pressure of greater than 100 kPa and less than or equal to 200 kPa, water is supplied to the spray head from the outside. Because the low pressure is not sufficient to cause the cover sheet 8 to close a respective one of the water passing holes 6 at the lower end of the spray head body 4, the water flows through a double-flow channel structure. The water enters the inner cavity of the spray head body 4 through the water passing holes 6, and then flows through the chamfered groove 12 to the first spray hole 1. Meanwhile, after the water flows from the inner cavity of the atomization core 5 and enters the second spray hole 2 through the water outlet holes 10 and the helical groove 13, the water mixes with the water that enters the first spray hole 1 from the spray head body 4 to be sprayed out of the spray head. Flow state under a medium to high pressure: At a medium to high inlet pressure of greater than 200 kPa and less than 500 kPa, the system pipeline supplies pesticide or fertilizer liquid to the spray head. Because the high pressure causes the cover sheet 8 to completely close a respective one of the water passing holes 6 at the lower end of the spray head body 4, the spray head turns into a single-flow channel spray head structure. The liquid enters the inner cavity of the atomization core 5, flows through the four water outlet holes 10, reaches the second spray head hole 2 through the two helical grooves 13 on the side surface of the upper end of the atomization core 5, and is then sprayed. Because the outlet diameter is small, the liquid pressure is increased, so that the liquid is compressed in the second spray hole 2 and broken into small droplets, thereby achieving a better atomization effect. The liquid can be sprayed high enough to reach the back of the grape leaves, thereby implementing fertilizer application and pesticide spraying.

What is claimed is:

1. A water-fertilizer-pesticide integrated multifunctional irrigation spray head, comprising a pipe connector and a spray head cap, wherein the spray head cap is mounted on the pipe connector, the spray head cap is provided with a first spray hole, a spray head body is nested inside the spray head cap, the spray head body is provided with a second spray hole at a position corresponding to the first spray hole, and a diameter of the second spray hole is less than a diameter of the first spray hole;

an end of the spray head body located at the pipe connector is provided with a plurality of water passing holes, a spring is mounted at each of the plurality of water passing holes, a cover sheet is fixed at an inlet of the each of the plurality of water passing holes by the spring, and the first spray hole is in communication with the plurality of water passing holes through a first cavity defined by an outer surface of the spray head body and an inner surface of the spray head cap; and an atomization core is nested inside the spray head body, the atomization core is provided with an atomization core inlet at the pipe connector, and the second spray hole is in communication with the atomization core inlet through a second cavity defined by an outer surface of the atomization core and an inner surface of the spray head body.

2. The water-fertilizer-pesticide integrated multifunctional irrigation spray head according to claim 1, wherein the spray head cap comprises an upper cap and a lower cap, and the spray head body comprises a first connection body, a second connection body and a first truncated cone body, wherein the plurality of water passing holes are provided on the first connection body, the second spray hole is provided on the first truncated cone body, an outer wall of the first connection body conforms and is fixed to an inner wall of the lower cap, an outer wall of the second connection body conforms and is fixed to an inner wall of the upper cap, the first connection body and the second connection body are connected by a third connection body, the second connection body is provided with a chamfered groove, the chamfered groove communicates a first segment of the first cavity defined by an outer wall of the first truncated cone body and the inner wall of the upper cap with a second segment of the first cavity defined by an outer wall of the third connection body and the inner wall of the upper cap, and the plurality of water passing holes are in communication with the second segment of the first cavity.

3. The water-fertilizer-pesticide integrated multifunctional irrigation spray head according to claim 1, wherein a cross-section of the first spray hole is a truncated cone-shaped cross-section, and a cross-section of the second spray hole is a cylindrical cross-section.

4. The water-fertilizer-pesticide integrated multifunctional irrigation spray head according to claim 2, wherein the outer wall of the first connection body is threadedly connected to the inner wall of the lower cap, and the outer wall of the second connection body is threadedly connected to the inner wall of the upper cap.

5. The water-fertilizer-pesticide integrated multifunctional irrigation spray head according to claim 2, wherein an angle α between the chamfered groove and a horizontal plane is in a range of $28°\leq\alpha\leq32°$.

6. The water-fertilizer-pesticide integrated multifunctional irrigation spray head according to claim 2, wherein the atomization core comprises a first core body, a second core body and a second truncated cone body, wherein the atomization core inlet is provided on the first core body, the second core body is located inside the first truncated cone body, an outer wall of the first core body conforms and is fixed to inner walls of the first connection body and the third connection body, an outer wall of the second truncated cone body conforms and is fixed to an inner wall of the first truncated cone body, the second truncated cone body is provided with a helical groove, the second core body is provided with a plurality of circular water outlet holes, and the plurality of circular water outlet holes are in communication with the atomization core inlet.

7. The water-fertilizer-pesticide integrated multifunctional irrigation spray head according to claim 6, wherein the outer wall of the first core body is threadedly connected to the inner walls of the first connection body and the third connection body, and the outer wall of the second truncated cone body is threadedly connected to the inner wall of the first truncated cone body.

8. The water-fertilizer-pesticide integrated multifunctional irrigation spray head according to claim 6, wherein an angle β between the helical groove and a horizontal plane is in a range of $40° \leq \beta \leq 50°$.

9. The water-fertilizer-pesticide integrated multifunctional irrigation spray head according to claim 1, wherein the pipe connector is threadedly connected to the spray head cap.

10. The water-fertilizer-pesticide integrated multifunctional irrigation spray head according to claim 1, wherein a pressure regulating valve is mounted on the pipe connector.

11. The water-fertilizer-pesticide integrated multifunctional irrigation spray head according to claim 2, wherein a cross-section of the first spray hole is a truncated cone-shaped cross-section, and a cross-section of the second spray hole is a cylindrical cross-section.

12. The water-fertilizer-pesticide integrated multifunctional irrigation spray head according to claim 2, wherein a pressure regulating valve is mounted on the pipe connector.

13. The water-fertilizer-pesticide integrated multifunctional irrigation spray head according to claim 3, wherein a pressure regulating valve is mounted on the pipe connector.

14. The water-fertilizer-pesticide integrated multifunctional irrigation spray head according to claim 4, wherein a pressure regulating valve is mounted on the pipe connector.

15. The water-fertilizer-pesticide integrated multifunctional irrigation spray head according to claim 5, wherein a pressure regulating valve is mounted on the pipe connector.

16. The water-fertilizer-pesticide integrated multifunctional irrigation spray head according to claim 6, wherein a pressure regulating valve is mounted on the pipe connector.

17. The water-fertilizer-pesticide integrated multifunctional irrigation spray head according to claim 7, wherein a pressure regulating valve is mounted on the pipe connector.

18. The water-fertilizer-pesticide integrated multifunctional irrigation spray head according to claim 8, wherein a pressure regulating valve is mounted on the pipe connector.

* * * * *